US009578934B2

(12) United States Patent
Waud

(10) Patent No.: US 9,578,934 B2
(45) Date of Patent: Feb. 28, 2017

(54) SYSTEMS, METHODS, AND DEVICES FOR SECURING A HAIR RETENTION DEVICE HIDDEN FROM VIEW USING A BRACELET

(71) Applicant: Haley Waud, Chicago, IL (US)

(72) Inventor: Haley Waud, Chicago, IL (US)

( * ) Notice: Subject to any disclaimer, the term of this patent is extended or adjusted under 35 U.S.C. 154(b) by 0 days.

(21) Appl. No.: 14/604,068

(22) Filed: Jan. 23, 2015

(65) Prior Publication Data

US 2016/0213103 A1 Jul. 28, 2016

(51) Int. Cl.
*A44C 5/00* (2006.01)

(52) U.S. Cl.
CPC ..... *A44C 5/003* (2013.01); *A44C 5/0007* (2013.01); *A44C 5/0084* (2013.01)

(58) Field of Classification Search
CPC ..... A44C 5/0007; A44C 5/003; A44C 15/003; A44C 25/00; A44C 5/0084
USPC ..... 63/1.14, 7, 33
See application file for complete search history.

(56) References Cited

U.S. PATENT DOCUMENTS

| | | | | | |
|---|---|---|---|---|---|
| 61,127 | A * | 1/1867 | Warner | A44C 5/003 | 40/728 |
| 1,832,161 | A * | 11/1931 | Weaver | A45C 1/04 | 224/222 |
| 2,262,548 | A * | 11/1941 | Genser | A44C 25/00 | 40/647 |
| 2,522,852 | A * | 9/1950 | Apps | A44C 5/0092 | 63/7 |
| 2,779,523 | A | 1/1957 | Klimkiewicz | | |
| 4,502,298 | A * | 3/1985 | Benton | A44C 5/003 | 224/219 |
| 6,540,369 | B2 * | 4/2003 | Granite | A44C 15/0015 | 362/104 |
| D567,701 | S * | 4/2008 | Nisguretsky | D11/39 | |
| D674,808 | S | 1/2013 | Axelrod | | |
| 8,875,892 | B1 * | 11/2014 | Warner | A61J 1/03 | 206/533 |
| 2013/0133365 | A1 * | 5/2013 | Zannella | A44C 5/003 | 63/1.11 |
| 2014/0318180 | A1 * | 10/2014 | Cabe | A44C 5/0007 | 63/5.1 |
| 2014/0326772 | A1 | 11/2014 | Pyper | | |
| 2015/0082830 | A1 * | 3/2015 | Ingimundarson | A44C 5/003 | 63/1.11 |

FOREIGN PATENT DOCUMENTS

| | | | |
|---|---|---|---|
| AU | 2011101340 | A4 | 10/2011 |
| ES | 1101930 | U | 3/2014 |
| KR | 20010077605 | A | 8/2001 |
| KR | 200426967 | Y1 | 9/2006 |
| KR | 20080000491 | A | 1/2008 |
| KR | 20120002193 | U | 3/2012 |
| KR | 2012012797 | A | 11/2012 |
| WO | WO8905594 | A1 | 6/1989 |

* cited by examiner

*Primary Examiner* — Emily Morgan
(74) *Attorney, Agent, or Firm* — Guntin & Gust, PLC; Atanu Das

(57) ABSTRACT

Embodiments of the present disclosure include systems, methods, and devices for securing a hair retention device hidden (at least partially) from view using a bracelet. Such embodiments include a bracelet having an annular shape. Further, the bracelet includes an annular cavity along a side of the bracelet to retain a hair retention device and an open cavity that allows a user to access the hair retention device.

5 Claims, 6 Drawing Sheets

SYSTEMS, METHODS, AND DEVICES FOR SECURING A HAIR RETENTION DEVICE HIDDEN FROM VIEW USING A BRACELET

CROSS-REFERENCE TO RELATED APPLICATIONS

The present application is related to the following U.S. application Ser. No. 29/515,536, filed Jan. 23, 2015, titled "Bracelet with a Cavity to Secure a Hair Band Hidden from View", the entire contents of which is being incorporated herein by reference.

BACKGROUND

Many professionals in their work environments must either put up or take down their hair depending on certain situations. Such situations may include putting their hair up for meetings, quality control in manufacturing, food service, and patient assistance as well as others. Other situations may call for professionals to put their hair down such as when they are alone in their own office or attending a formal professional event.

Professionals may wear a number of different hair retention devices to put up their hair that include but are not limited to, hair bands, hair clips, hair elastic bands, or any other hair retention devices. In further situations, professionals may need to put up or take down their hair in a spur of a moment. In foreseeing such situations, professionals may sometimes have their hair down and wear hair retention devices including hair elastic bands around their wrists such that the hair band is handy or easily within reach to quickly put up their hair in case such a situation arises. However, wearing a hair band in plain view on a person's wrist may be unprofessional in certain work environments. Further, some bracelets or other devices may be able to secure a hair band and hide it from view but when the need to access the hair band quickly, in the spur of the moment, accessing the hair band may take an inconveniently long time from such bracelets.

Accordingly, there is a need for systems, methods, and devices for securing a hair retention device hidden from view using a bracelet but is still easily and quickly accessible to a professional when moving from one work environment to another.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
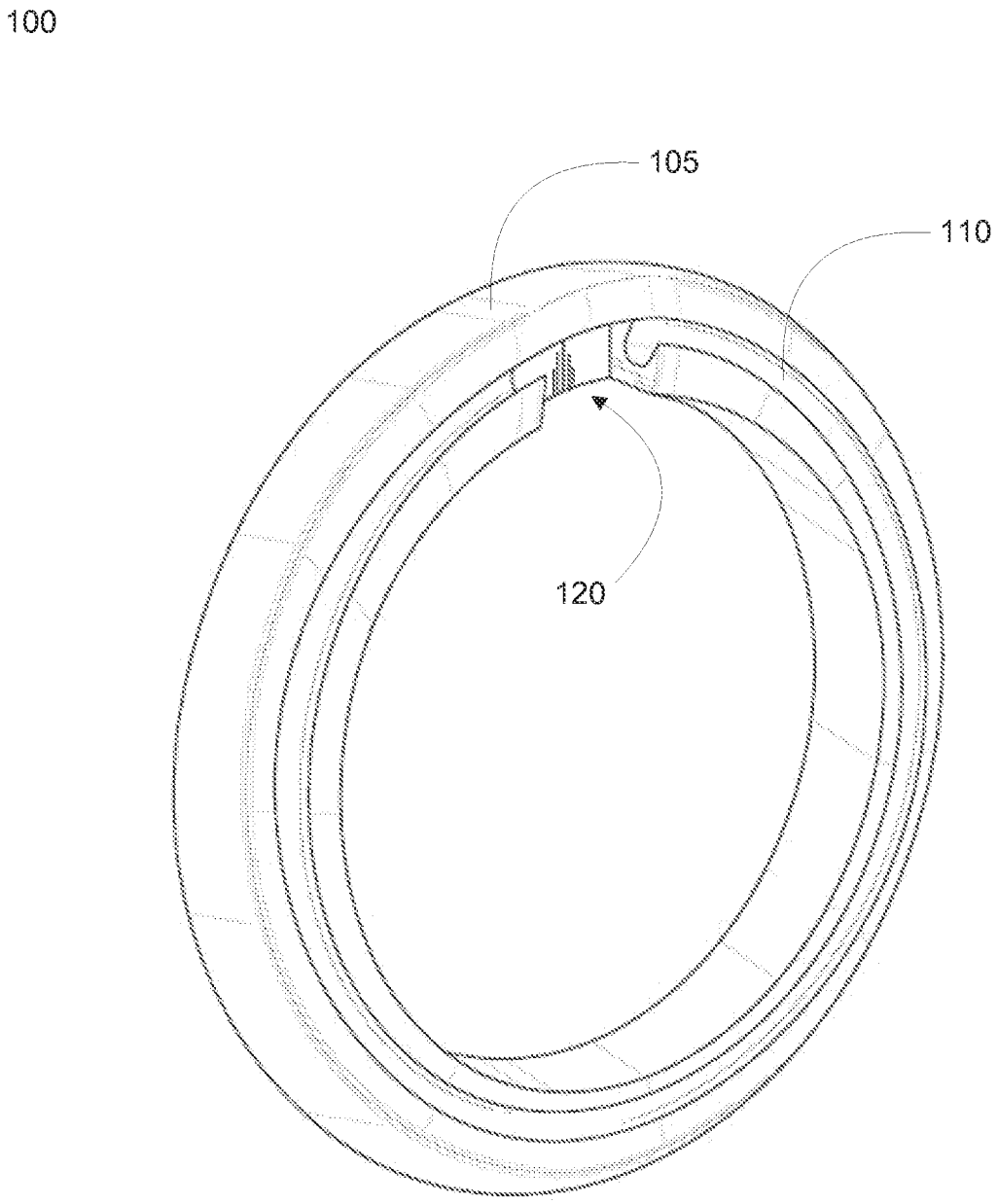
FIG. 1 is a diagram of a device for securing a hair retention device hidden from view using a bracelet, in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

The illustrative embodiments described in the detailed description, drawings, and claims are not meant to be limiting. Other embodiments may be utilized, and other changes may be made, without departing from the scope of the subject matter presented herein. It will be readily understood that the aspects of the present disclosure, as generally described herein, and illustrated in the Figures, can be arranged, substituted, combined, separated, and designed in a wide variety of difference configurations, all of which are explicitly contemplated herein. Further, in the foregoing description, numerous details are set forth to further describe and explain one or more embodiments. These details include system configurations, block module diagrams, flowcharts (including transaction diagrams), and accompanying written description. While these details are helpful to explain one or more embodiments of the disclosure, those skilled in the art will understand that these specific details are not required in order to practice the embodiments.

Embodiments of the present disclosure include systems, methods, and devices for securing a hair retention device hidden (at least partially) from view using a bracelet. Such embodiments include a bracelet having an annular shape. Further, the bracelet includes an annular cavity along a side of the bracelet to retain a hair retention device and an open cavity that allows a user to access the hair retention device.

FIG. 1 is a diagram of a device 100 for securing a hair retention device hidden from view using a bracelet 105, in accordance with some embodiments. The device 100 includes a bracelet 105. Further, the bracelet 105 may be of an annular (e.g. ring) shape. In addition, the bracelet 105 may include an annular cavity 110 along the side of the bracelet 105 that can retain the hair retention device and hide the hair retention device (at least partially) from view. Also, the bracelet 105 may include an open cavity 120 on the side of the bracelet that allows a user to access a hair retention device placed in the annular cavity 110.

Thus, when the user (which can be any professional in any work environment as well as a recreational environment (e.g. bar/club/party, etc.) or in any environment) of the device 100 would like put his/her hair down in the work environment, the user may easily take the hair retention device out of his/her hair and placed it into the annular cavity 110. Further, if the work environment changes in a spur of the moment, the user may access the hair retention device retained by the annular cavity 110 by placing a two fingers near the open cavity 120 and pulling or accessing the hair retention device from the annular cavity 110 to put his/her hair up. In some embodiments, the bracelet 105 may be worn such that the annular cavity 110 is facing toward the hand of the user.

In other embodiments, the annular cavity 110 may be on the bottom of the bracelet 105 such that the annular cavity 110 can retain the hair retention device and (at least partially) hide the hair retention device from view. Further, in such embodiments, the open cavity 120 may be on the bottom of the bracelet 105 or on the side of the bracelet 105 thereby allowing the user to access the hair retention device placed in the annular cavity 110.

Note, on other embodiments, the bracelet may be of any shape and the cavity that retains the hair retention device may also be any shape (including a shape different than the shape of the hair retention device). Further, the open cavity can also be any shape that allows a user of the device to access the hair retention device.

Figure 2A:
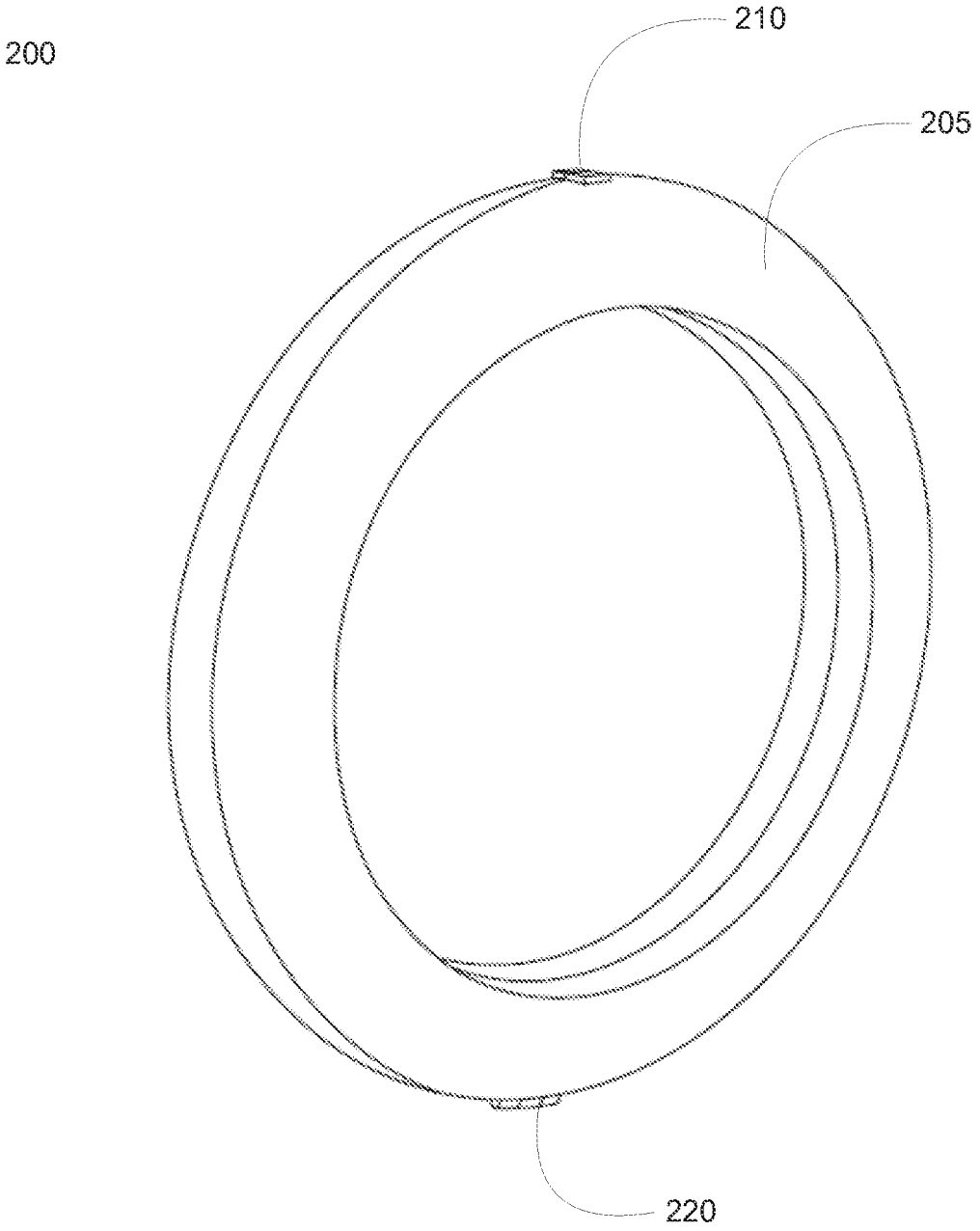
FIGS. 2A-2C are diagrams of another device for securing a hair retention device hidden from view using a bracelet, in accordance with some embodiments.
Figure 2B:
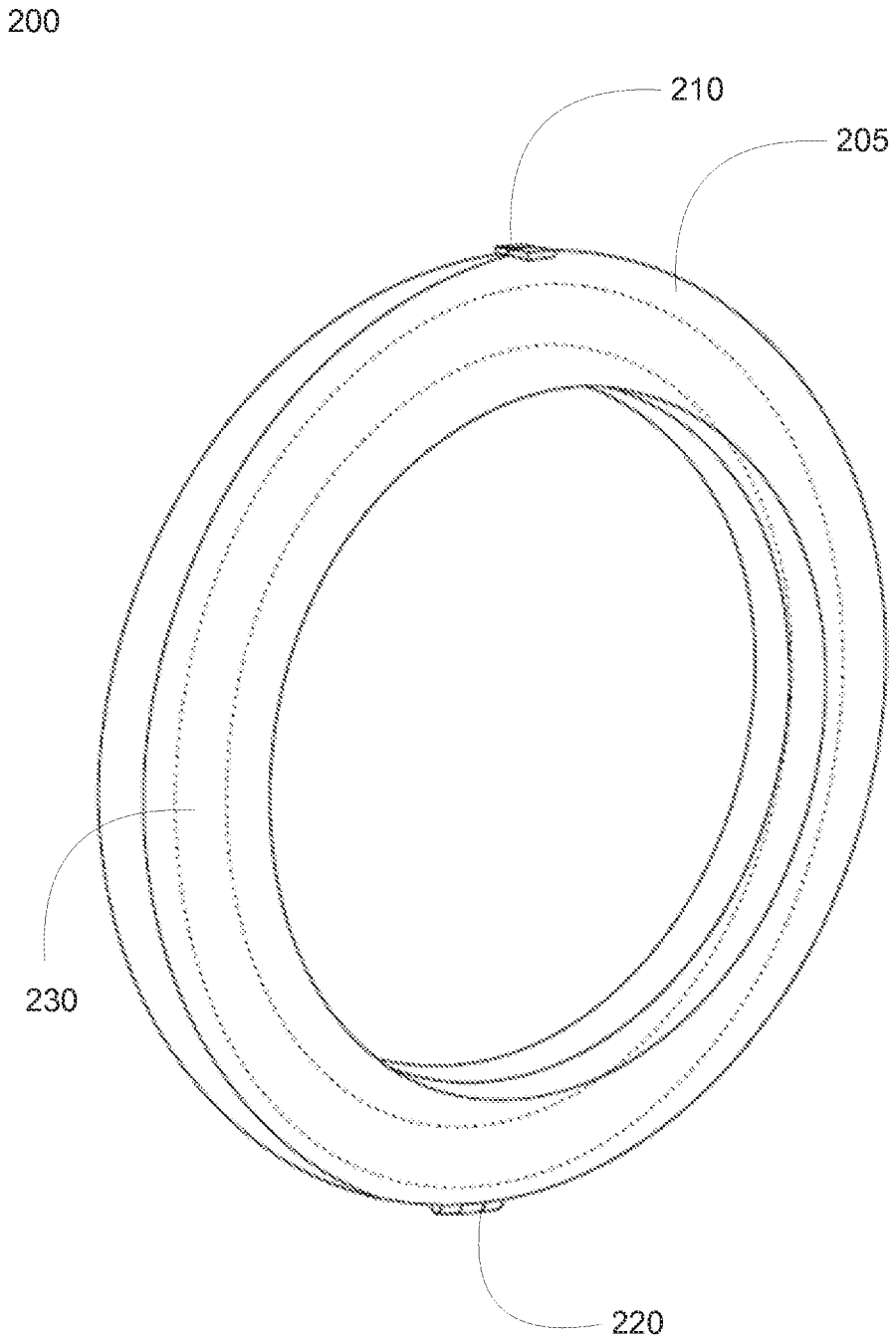
Figure 2C:
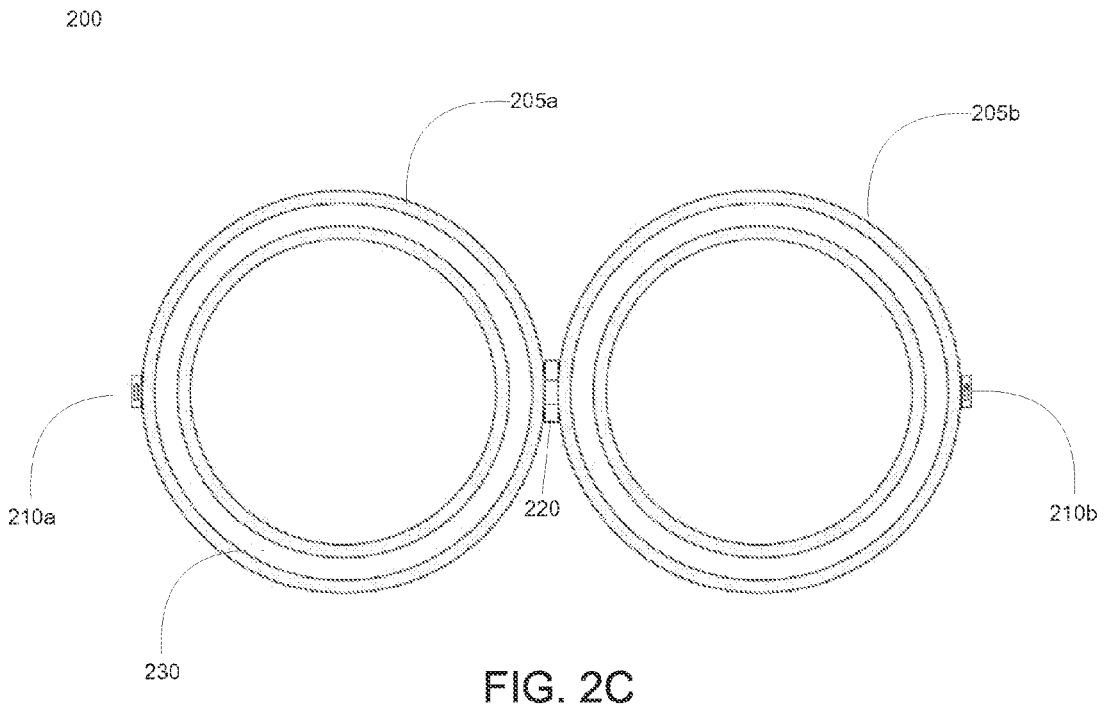

FIGS. 2A-2C are diagrams of another device 200 for securing a hair retention device hidden from view using a bracelet 205, in accordance with some embodiments. The device 200 includes a bracelet 205, a clasp 210 and a hinge 220. The bracelet 205 may open up in a clamshell like fashion, pivoting on hinge 220. Further, the clasp 210 is used to keep the bracelet 205 in a closed position. In some embodiments, the clasp 210 may be of two parts, one on the top part of the bracelet 205 and the other on the bottom part of the bracelet 205 such that the two parts of the clasp are coupled in the closed position. Further, there may be a tab, button, or some other mechanism for a user to uncouple one part of the clasp 210 from the other part to open the bracelet 205.

Referring to FIG. 2B, the bracelet 205 is in the closed position with one part of the clasp 210 on the top of the bracelet 205 coupled to the other part of the clasp 210 on the bottom of the bracelet 205. Further, an annular cavity 230 is shown with bracelet 205. The annular cavity may be used to store a hair band or some other hair retention device.

Referring to FIG. 2C, the bracelet 205 is in the open position such that one part of the clasp 210*a* on the top of the bracelet 205*a* is uncoupled to the other part of the clasp 210*b* on the bottom of the bracelet 205*b*. Further, the opening of the bracelet pivots on hinge 220. In addition, the annular cavity 230 can be used to store a hair band or some other hair retention device. Once the hair retention device is placed in the annular cavity 230, the user may close the bracelet by coupling one part of the clasp 210 to the other part of the clasp 210*b* thereby (at least partially) hiding the hair retention device from view.

Figure 3:
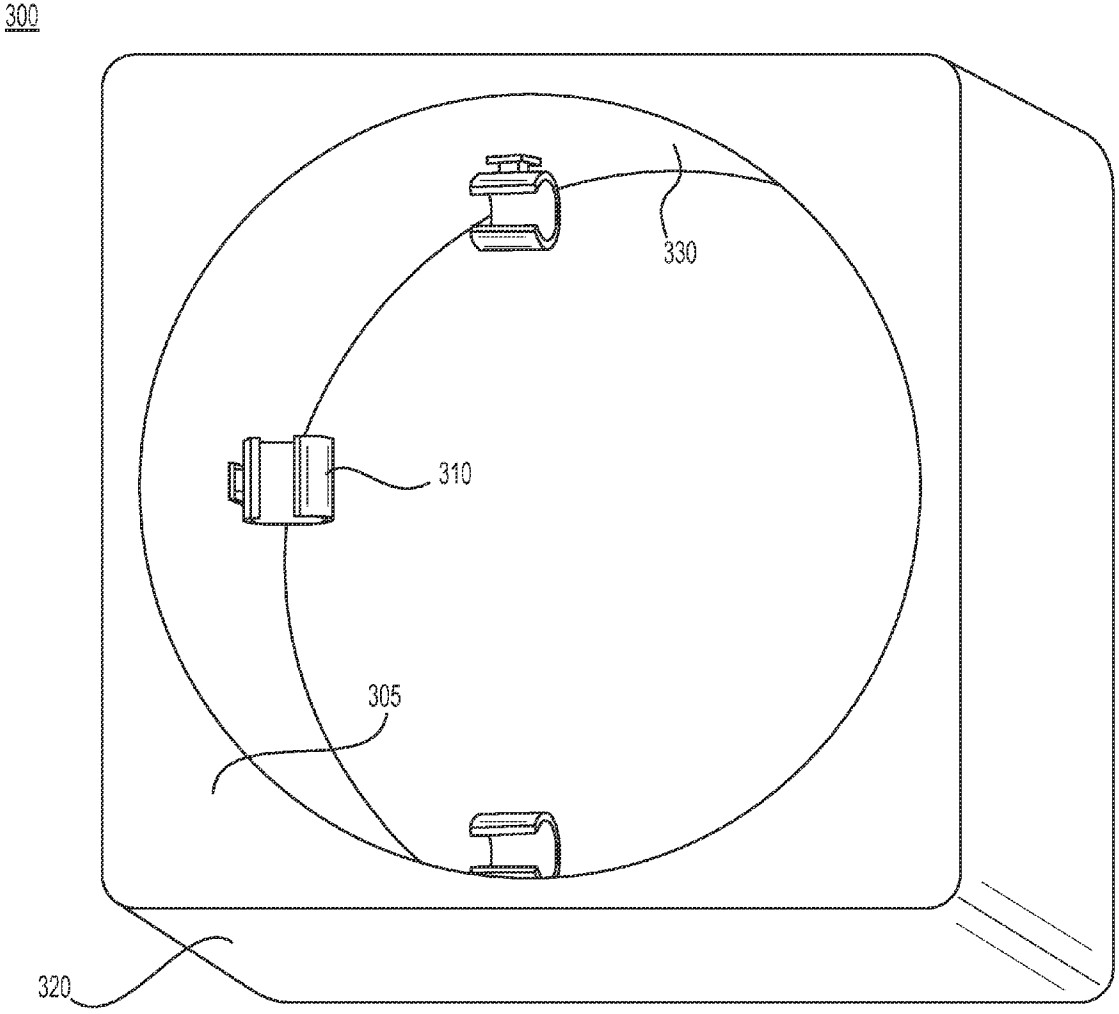
FIG. 3 is a diagram of another device for securing a hair retention device hidden from view using a bracelet, in accordance with some embodiments.

FIG. 3 is a diagram of another device 300 for securing a hair retention device hidden from view using a bracelet 305, in accordance with some embodiments. The bracelet shown in FIG. 3 has a rectangular outer surface 320 and a circular inner surface 330. Other embodiments may have a bracelet's inner and outer surfaces both be circular or the bracelet's inner and outer surfaces both be rectangular. Further, persons of ordinary skill in the art would understand that the inner and outer surfaces of a bracelet described herein may have any combination of shapes for each of the inner surface and outer surface of the bracelet.

In addition, the bracelet 305 may have hooks, clasps, or other couplers to secure or retain hair retention devices to the inner surface 330 of the bracelet 305. The hooks 310 secure the hair band (or other hair retention device) in place along the inner surface 330 of the bracelet 305. Securing the hair retention device in place along the inner surface of the bracelet 305 (at least partially) hides the hair retention device from view.

Figure 4:
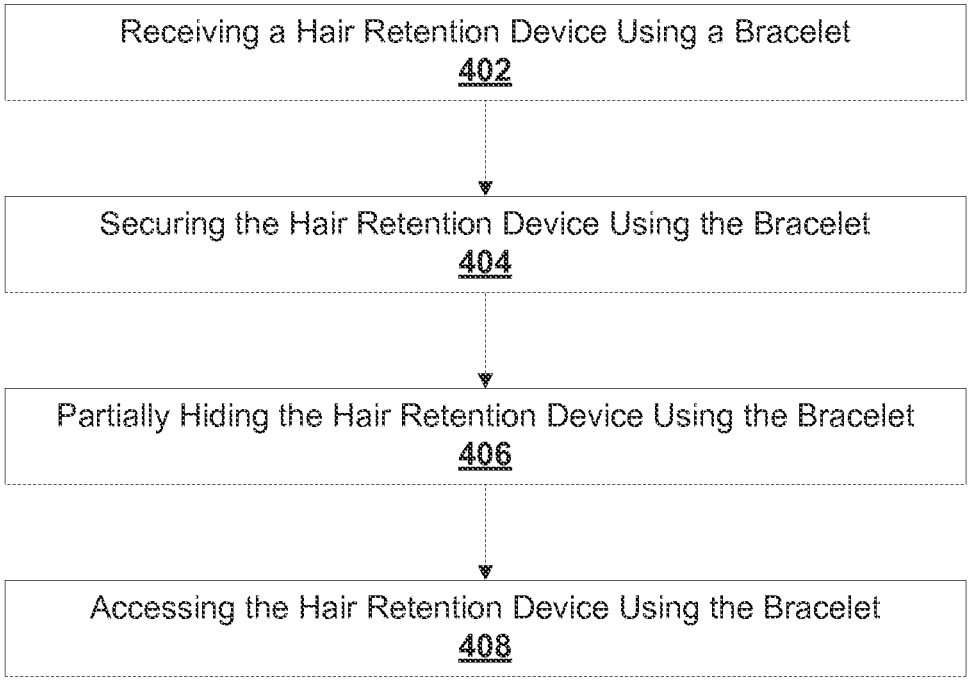
FIG. 4 is a flowchart of a method of securing a hair retention device hidden from view using a bracelet, in accordance with some embodiments.

FIG. 4 is a flowchart of a method 400 of securing a hair retention device hidden from view using a bracelet, in accordance with some embodiments. The method 400 includes receiving a hair retention device (e.g. hair band) using a bracelet, as shown in block 402. Further, the method 400 includes securing the hair retention device using the bracelet, as shown in block 404. In addition, the method 400 includes at least partially hiding the hair retention device from view using the bracelet, as shown in block 406. Also, the method 400 includes accessing the hair retention device using the bracelet, as shown in block 408.

In some embodiments, the bracelet has an annular shape. Further, the bracelet includes an annular cavity along a circumference of the bracelet to receive and secure the hair retention device and at least partially hides the hair retention device. In addition, the bracelet further includes an open cavity that allows a user to access the hair retention device. In other embodiments, the bracelet further includes a clasp having a first part of the clasp coupled to the top side of the bracelet and a second part of the clasp coupled to the bottom side of the bracelet. The first part of the clasp and the second part of the clasp couple together to place the bracelet in a closed position thereby at least partially hiding the hair retention device. In additional embodiments, the bracelet further includes a hinge such that the hinge is used to pivot the bracelet from the closed position to an open position.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

I claim:

1. A device, comprising:

a bracelet having an annular shape, the bracelet comprising a front surface, a rear surface having a circumference, a top surface, and a bottom surface configured to be positioned closest to a wrist of a user;

an annular cavity contiguously defined along the circumference of the rear surface, the rear surface having a portion adjacent to the bottom surface, the annular cavity is configured to receive, partially hide, and secure a hair retention device; and an open cavity that exposes the annular cavity through the bottom surface and the portion of the rear surface adjacent to the bottom surface, the open cavity is configured to access the hair retention device.

2. A method, comprising:

providing a bracelet having an annular shape, the bracelet comprising a front surface, a rear surface having a circumference, a top surface, and a bottom surface configured to be positioned closest to a wrist of a user, wherein the bracelet comprises an annular cavity contiguously defined along the circumference of the rear surface, the rear surface having a portion adjacent to the bottom surface, the annular cavity configured to receive, partially hide, and secure a hair retention device, and wherein the bracelet comprises an open cavity that exposes the annular cavity through the bottom surface and the portion of the rear surface adjacent to the bottom surface of the bracelet, the open cavity is configured to access the hair retention device, and inserting a hair retention device into the annular cavity of a bracelet.

3. The device of claim 1, wherein the front surface, the rear surface, the top surface, and the bottom surface are each a flat surface.

4. The method of claim 2, wherein the front surface, the rear surface, the top surface, and the bottom surface are each a flat surface.

5. The method of claim 2, further comprising removing the hair retention device using the open cavity.

* * * * *